US012084849B1

(12) United States Patent
Maurice

(10) Patent No.: US 12,084,849 B1
(45) Date of Patent: Sep. 10, 2024

(54) AIR VENT FOR CULVERT

(71) Applicant: Louis Maurice, New Liskeard (CA)

(72) Inventor: Louis Maurice, New Liskeard (CA)

( * ) Notice: Subject to any disclaimer, the term of this patent is extended or adjusted under 35 U.S.C. 154(b) by 189 days.

(21) Appl. No.: 17/880,046

(22) Filed: Aug. 3, 2022

(51) Int. Cl.
*E03F 5/08* (2006.01)
*E01F 5/00* (2006.01)

(52) U.S. Cl.
CPC ..... *E03F 5/08* (2013.01); *E01F 5/005* (2013.01)

(58) Field of Classification Search
CPC ..... E01F 5/005; E03F 5/08
See application file for complete search history.

(56) References Cited

U.S. PATENT DOCUMENTS

| | | | | | |
|---|---|---|---|---|---|
| 861,302 | A | | 7/1907 | Mibach | |
| 2,246,012 | A | | 6/1941 | Ernest | |
| 3,504,708 | A | | 4/1970 | Rene | |
| 4,596,491 | A | * | 6/1986 | Dietzler | F16L 9/18 405/154.1 |
| 4,972,905 | A | | 11/1990 | Henson | |
| 5,209,257 | A | * | 5/1993 | Baker, Jr. | E03F 5/08 137/433 |
| 6,739,469 | B1 | | 5/2004 | Kim | |
| 2008/0202596 | A1 | | 8/2008 | Kato | |
| 2009/0044321 | A1 | * | 2/2009 | Selman | E03C 1/12 4/219 |
| 2009/0173396 | A1 | | 7/2009 | Spadavecchia | |
| 2012/0261006 | A1 | * | 10/2012 | Cashen | F16K 24/06 137/488 |
| 2013/0065504 | A1 | * | 3/2013 | Alemao | E03F 5/08 454/275 |
| 2013/0305441 | A1 | * | 11/2013 | Williamson | E03F 5/08 4/219 |
| 2013/0315670 | A1 | * | 11/2013 | Haire | E02B 13/02 405/125 |
| 2016/0090722 | A1 | * | 3/2016 | McAlpine | E03F 5/08 137/843 |
| 2018/0087261 | A1 | * | 3/2018 | Iwasa | E03F 5/08 |
| 2018/0305917 | A1 | * | 10/2018 | LaVancher | B01D 53/14 |
| 2020/0087884 | A1 | * | 3/2020 | Rigby | E02D 29/12 |

* cited by examiner

*Primary Examiner* — Kevin R Barss
(74) *Attorney, Agent, or Firm* — Kyle A. Fletcher, Esq.

(57) ABSTRACT

The air vent for culvert is a vent. The air vent for culvert is configured for use with a culvert. The air vent for culvert forms a fluidic connection between the interior space of the culvert and the atmosphere. The air vent for culvert equalizes the gas pressure between the atmosphere and interior of the culvert such that a fluid flows freely through the culvert. The air vent for culvert incorporates a base structure, an equalizing pipe, and a threaded connection. The threaded connection secures the equalizing pipe to the base structure. The base structure secures the equalizing pipe and the culvert. The base structure forms a fluidic connection between the interior of the culvert and the equalizing pipe.

12 Claims, 5 Drawing Sheets

AIR VENT FOR CULVERT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of head structures for culverts. (E01F5/005)

SUMMARY OF INVENTION

The air vent for culvert is a vent. The air vent for culvert is configured for use with a culvert. The culvert is defined elsewhere in this disclosure. The air vent for culvert forms a fluidic connection between the interior space of the culvert and the atmosphere. The air vent for culvert equalizes the gas pressure between the atmosphere and interior of the culvert such that a fluid flows freely through the culvert. The air vent for culvert comprises a base structure, an equalizing pipe, and a threaded connection. The threaded connection secures the equalizing pipe to the base structure. The base structure secures the equalizing pipe and the culvert. The base structure forms a fluidic connection between the interior of the culvert and the equalizing pipe.

These together with additional objects, features and advantages of the air vent for culvert will be readily apparent to those of ordinary skill in the art upon reading the following detailed description of the presently preferred, but nonetheless illustrative, embodiments when taken in conjunction with the accompanying drawings.

In this respect, before explaining the current embodiments of the air vent for culvert in detail, it is to be understood that the air vent for culvert is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the air vent for culvert.

It is therefore important that the claims be regarded as including such equivalent construction insofar as they do not depart from the spirit and scope of the air vent for culvert. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
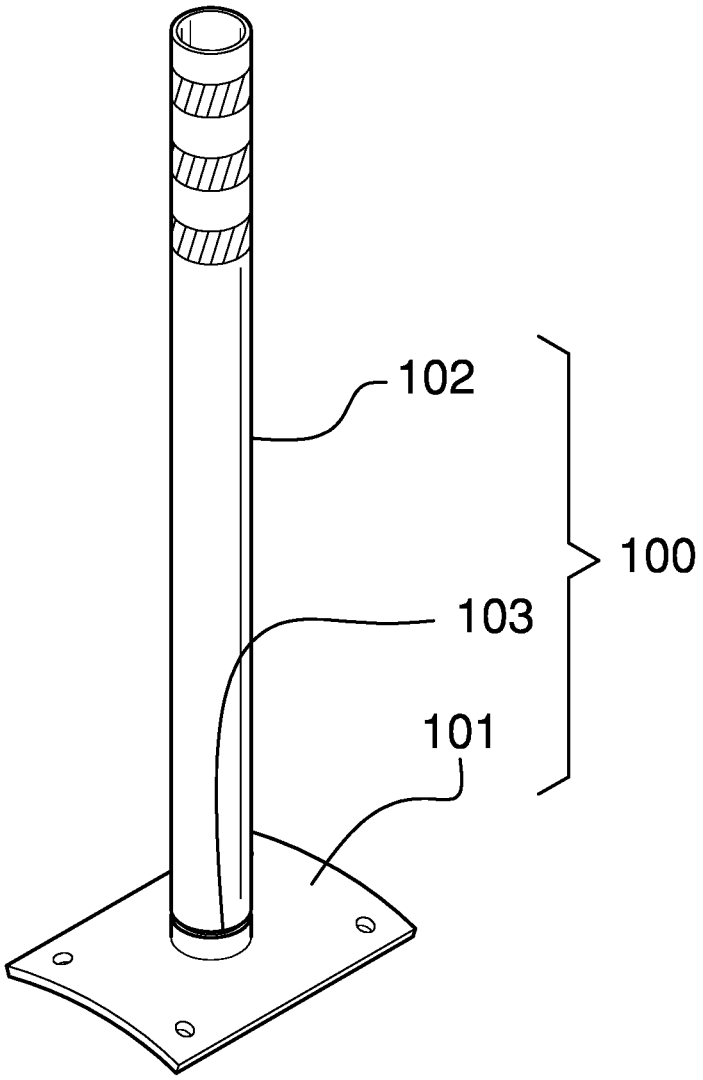
FIG. 1 is a perspective view of an embodiment of the disclosure.
Figure 2:
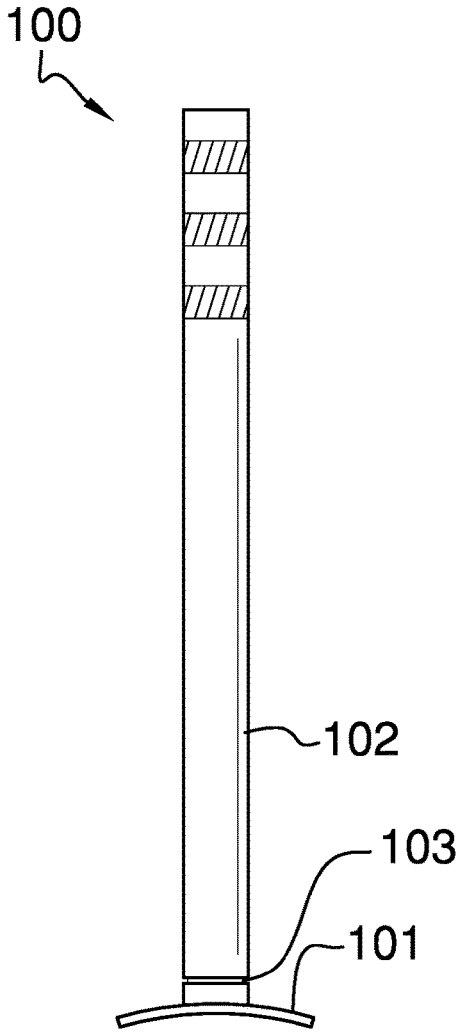
FIG. 2 is a front view of an embodiment of the disclosure.
Figure 3:
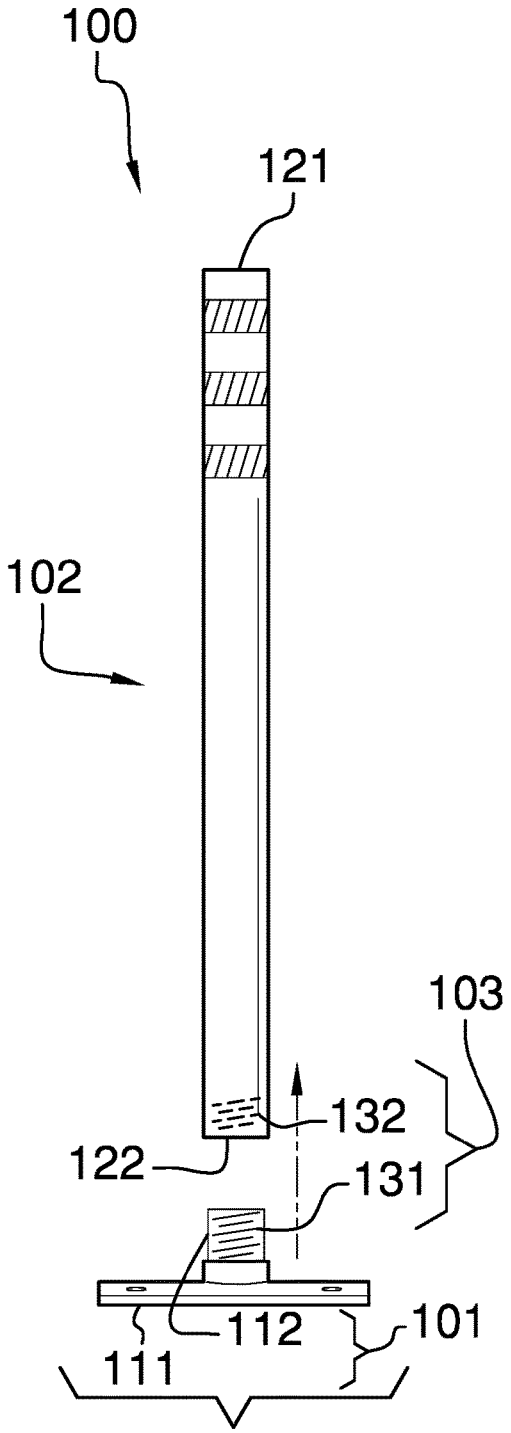
FIG. 3 is a side view of an embodiment of the disclosure.
Figure 4:
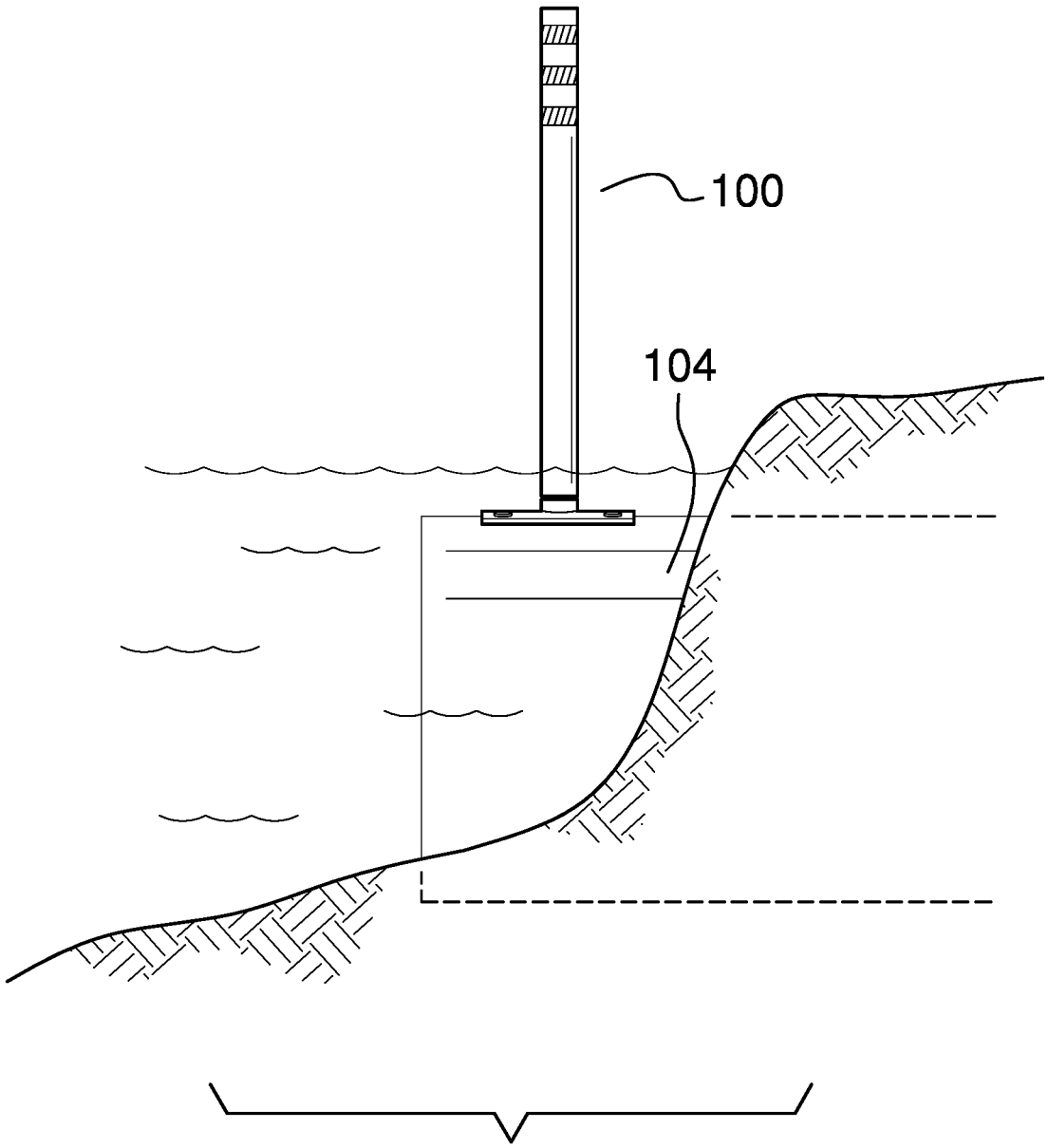
FIG. 4 is an in-use view of an embodiment of the disclosure.
Figure 5:
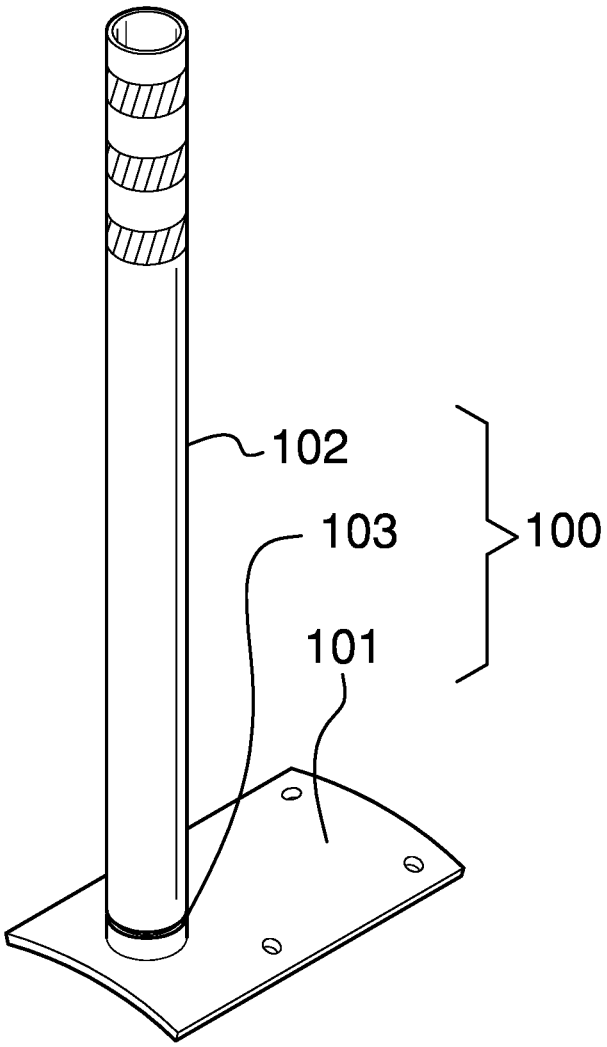
FIG. 5 is a perspective view of an embodiment of the disclosure.
Figure 6:
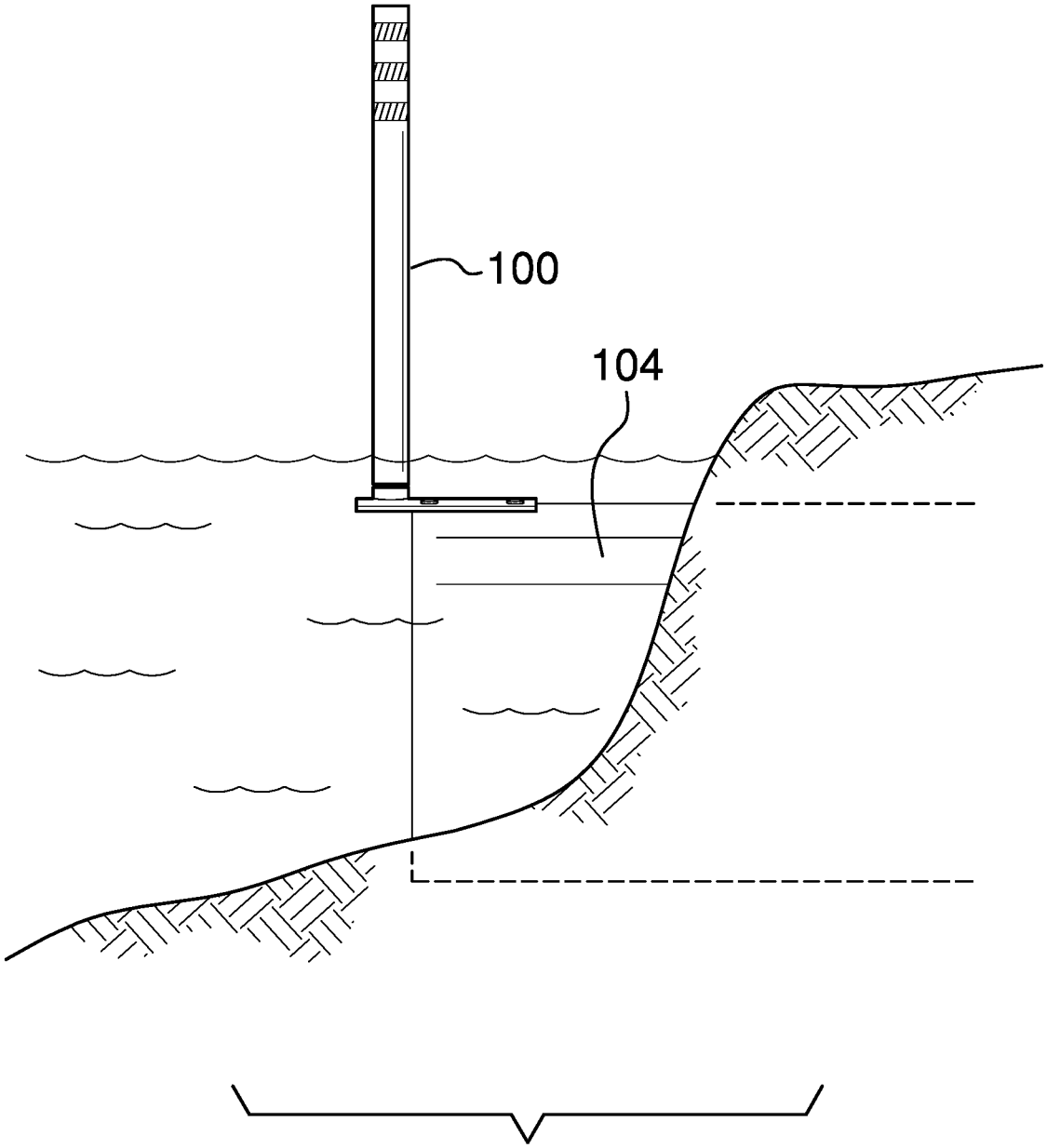
FIG. 6 is an in-use view of an embodiment of the disclosure.

Detailed reference will now be made to one or more potential embodiments of the disclosure, which are illustrated in FIGS. 1 through 6.

The air vent for culvert 100 (hereinafter invention) is a vent. The invention 100 is configured for use with a culvert 104. The culvert 104 is defined elsewhere in this disclosure. The invention 100 forms a fluidic connection between the interior space of the culvert 104 and the atmosphere. The invention 100 equalizes the gas pressure between the atmosphere and interior of the culvert 104 such that a fluid flows freely through the culvert 104. The invention 100 comprises a base structure 101, an equalizing pipe 102, and a threaded connection 103. The threaded connection 103 secures the equalizing pipe 102 to the base structure 101. The base structure 101 secures the equalizing pipe 102 and the culvert 104. The base structure 101 forms a fluidic connection between the interior of the culvert 104 and the equalizing pipe 102.

The culvert 104 is a prism shaped structure. The culvert 104 forms a pipe. The culvert 104 forms a fluidic connection between a first body of water and a second body of water. The culvert 104 forms a flow path that allows water to flow between the first and second bodies of water.

The base structure 101 is a mechanical structure. The base structure 101 is a mounting structure. The base structure 101 secures the equalizing pipe 102 to the culvert 104. The base structure 101 forms the fluidic connection that equalizes the gas pressure between the atmosphere and the culvert 104. The base structure 101 comprises a base plate 111 and a connecting pipe 112.

The base plate 111 is a disk shaped structure. The base plate 111 is formed with a non-Euclidean disk structure. The base plate 111 is geometrically similar to the lateral face of the prism structure of the culvert 104. Specifically, the concave surface of the non-Euclidean disk structure of the base plate 111 is geometrically identical to the curvature of the convex surface of the lateral face of the prism structure of the culvert 104 such that the base plate 111 rests flush on the culvert 104. The base plate 111 protects a fluidic connection between the culvert 104 and the connecting pipe 112. By protecting the fluidic connection is meant that the base plate 111 forms a fluid impermeable seal that prevents a fluid from escaping the combined containment space formed by the connecting pipe 112 and the base plate 111. The base plate 111 permanently attaches to the culvert 104.

The connecting pipe 112 is a prism shaped structure. The connecting pipe 112 is a hollow structure. The connecting pipe 112 forms a pipe. The connecting pipe 112 forms a fluidic connection between the equalizing pipe 102 and the culvert 104. The equalizing pipe 102 is a pipe. The equalizing pipe 102 forms the fluidic connection that equalizes the gas pressure between the atmosphere and the culvert 104. The equalizing pipe 102 comprises a superior congruent end 121 and an inferior congruent end 122.

The superior congruent end 121 is an open congruent end of the pipe structure of the equalizing pipe 102. The superior congruent end 121 transfers gasses between the atmosphere and the culvert 104 during the pressure equalization process.

The inferior congruent end 122 is an open congruent end of the pipe structure of the equalizing pipe 102. The inferior congruent end 122 is the congruent end of the equalizing pipe 102 that is distal from the superior congruent end 121. The inferior congruent end 122 attaches the equalizing pipe 102 to the connecting pipe 112 of the base structure 101. The inferior congruent end 122 forms a fluid impermeable seal between the equalizing pipe 102 and the connecting pipe 112. The inferior congruent end 122 forms the fluidic connection between the equalizing pipe 102 and the gases contained in the connecting pipe 112 and the culvert 104.

The threaded connection 103 is a fastening device. The threaded connection 103 is defined elsewhere in this disclosure. The threaded connection 103 removably attaches the equalizing pipe 102 to the base structure 101. The threaded connection 103 comprises an exterior screw thread 131 and an interior screw thread 132.

The exterior screw thread 131 forms a portion of the threaded connection 103. The exterior screw thread 131 is a helical structure that is formed on the exterior surface of the lateral face of the connecting pipe 112.

The interior screw thread 132 forms a portion of the threaded connection 103. The interior screw thread 132 is a helical structure that is formed on the interior surface of the lateral face of the equalizing pipe 102. The interior screw thread 132 is located at the inferior congruent end 122 of the equalizing pipe 102. The interior screw thread 132 is formed such that the exterior screw thread 131 screws into the interior screw thread 132 to form a fluid impermeable seal.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Culvert: As used in this disclosure, a culvert is an enclosed mechanical structure used to transport a fluid from a first body of fluid to a second body of water. The culvert forms a fluidic connection between the first body of fluid to the second body of water. The culvert is generally used to route a flow of water around or through an obstacle such as a road.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not to absorb through the exterior surfaces of the material a fluid that the material is immersed in or exposed to.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Flush: As used in this disclosure, the term flush is used to describe the alignment of a first surface and a second surface to form a single structure selected from the group consisting of a Euclidean plane and a non-Euclidean plane.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Line: A non-Euclidean line is a line that is formed with a curvature. Specifically, a non-Euclidean line comprises a set of points wherein the path of the span of the shortest distance between at least two points selected from the line does not lie on the path of the line itself. When a non-Euclidean line forms a section of the perimeter of a structure, the non-Euclidean line is often called a non-Euclidean edge.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Solid: As used in this disclosure, a solid refers to a state (phase) of matter that: 1) has a fixed volume; and, 2) does not flow.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vent: As used in this disclosure, a vent is an opening in a structure that allows for the flow of gas through the boundary of the structure.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Water: As used in this disclosure, water (CAS 7732-18-5) is a molecule comprising two hydrogen atoms and one oxygen molecule. The phase of water at normal temperature and pressure is liquid. As used in this disclosure, the definition of water is expanded to include dilute water-based solutions of salts and ionic structures using water as the solvent. Water in a gas phase is often referred to as steam. Water in a solid phase is often referred to as ice. Snow refers to a bulk solid form of ice.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An air vent for culvert comprising a base structure, an equalizing pipe, and a threaded connection;

wherein the threaded connection secures the equalizing pipe to the base structure;

wherein the base structure secures the equalizing pipe and to the culvert;

wherein the equalizing pipe comprises a superior congruent end and an inferior congruent end;

wherein the superior congruent end is an open congruent end of the pipe structure of the equalizing pipe;

wherein the superior congruent end transfers gasses between the atmosphere and the culvert during the pressure equalization process;

wherein the inferior congruent end is an open congruent end of the pipe structure of the equalizing pipe;

wherein the inferior congruent end is the congruent end of the equalizing pipe that is distal from the superior congruent end;

wherein the inferior congruent end attaches the equalizing pipe to the connecting pipe of the base structure;

wherein the inferior congruent end forms a fluid impermeable seal between the equalizing pipe and the connecting pipe;

wherein the inferior congruent end forms the fluidic connection between the equalizing pipe and the gases contained in the connecting pipe and the culvert.

2. The air vent for culvert according to claim 1 wherein the air vent for the culvert is configured for use with a culvert;

wherein the air vent for the culvert forms a fluidic connection between the interior space of the the culvert and the atmosphere;

wherein the air vent for the culvert equalizes the gas pressure between the atmosphere and interior of the culvert such that a fluid flows freely through the culvert.

3. The air vent for culvert according to claim 2 wherein the base structure forms a fluidic connection between the interior of the culvert and the equalizing pipe.

4. The air vent for culvert according to claim 3 wherein the culvert forms a pipe;

wherein the culvert forms a fluidic connection between a first body of water and a second body of water;

wherein the culvert forms a flow path that allows water to flow between the first and second bodies of water.

5. The air vent for culvert according to claim 4 wherein the base structure is a mechanical structure;

wherein the base structure is a mounting structure;

wherein the base structure secures the equalizing pipe to the culvert;

wherein the base structure forms a portion of the fluidic connection that equalizes the gas pressure between the atmosphere and the culvert.

6. The air vent for culvert according to claim 5 wherein the equalizing pipe is a pipe;

wherein the equalizing pipe forms the fluidic connection that equalizes the gas pressure between the atmosphere and the culvert.

7. The air vent for culvert according to claim 6 wherein the base structure comprises a base plate and a connecting pipe;

wherein the connecting pipe attaches to the base plate.

8. The air vent for culvert according to claim 7 wherein the base plate is a disk shaped structure;

wherein the base plate is formed with a non-Euclidean disk structure;

wherein the base plate is geometrically similar to the lateral face of the culvert;

wherein specifically, the concave surface of the non-Euclidean disk structure of the base plate is geometrically identical to the curvature of the convex surface of the lateral face of the culvert such that the base plate rests flush on the culvert.

9. The air vent for culvert according to claim 8 wherein the base plate protects a fluidic connection between the culvert and the connecting pipe;

wherein by protecting the fluidic connection is meant that the base plate forms a fluid impermeable seal that prevents a fluid from escaping the combined containment space formed by the connecting pipe and the base plate;

wherein the base plate permanently attaches to the culvert.

10. The air vent for culvert according to claim 9 wherein the connecting pipe is a hollow structure;

wherein the connecting pipe forms a pipe;

wherein the connecting pipe forms a fluidic connection between the equalizing pipe and the culvert.

11. The air vent for culvert according to claim 10 wherein the threaded connection is a fastening device;

wherein the threaded connection removably attaches the equalizing pipe to the base structure.

12. The air vent for culvert according to claim 11 wherein the threaded connection comprises an exterior screw thread and an interior screw thread, wherein the exterior screw thread forms a portion of the threaded connection;

wherein the exterior screw thread is a helical structure that is formed on the exterior surface of the lateral face of the connecting pipe;

wherein the interior screw thread forms a portion of the threaded connection;

wherein the interior screw thread is a helical structure that is formed on the interior surface of the lateral face of the equalizing pipe;

wherein the interior screw thread is located at the inferior congruent end of the equalizing pipe;

wherein the interior screw thread is formed such that the exterior screw thread screws into the interior screw thread to form a fluid impermeable seal.

* * * * *